US007079089B2

(12) United States Patent
Kwon et al.

(10) Patent No.: US 7,079,089 B2
(45) Date of Patent: Jul. 18, 2006

(54) GRAY DISPLAY METHOD AND DEVICE FOR PLASMA DISPLAY PANEL

(75) Inventors: Tae-Kyong Kwon, Cheonan (KR); Sang-Chul Kim, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 397 days.

(21) Appl. No.: 10/197,656

(22) Filed: Jul. 18, 2002

(65) Prior Publication Data

US 2003/0038759 A1 Feb. 27, 2003

(30) Foreign Application Priority Data

Aug. 24, 2001 (KR) ..... 2001-51425

(51) Int. Cl.
*G09G 3/28* (2006.01)
*G09G 3/36* (2006.01)

(52) U.S. Cl. ..... 345/63; 345/60; 345/89; 345/690

(58) Field of Classification Search ..... 345/37, 345/41, 60–65, 69, 89–90, 204, 690; 315/169.1–169.3
See application file for complete search history.

(56) References Cited

U.S. PATENT DOCUMENTS 4,945,351 A * 7/1990 Naiman ..... 345/589
6,339,434 B1 * 1/2002 West et al. ..... 345/667
6,630,917 B1 * 10/2003 Van Dijk ..... 345/60

FOREIGN PATENT DOCUMENTS

JP 11-073157 3/1999
JP 11-327491 11/1999

* cited by examiner

*Primary Examiner*—Vijay Shankar
(74) *Attorney, Agent, or Firm*—H.C. Park & Associates, PLC

(57) ABSTRACT

A method for displaying gray levels in a PDP by generating gray data corresponding to externally input image signals and displaying the gray data on the PDP is disclosed. The method comprises generating reference signals based on the image signals, determining a spread filter value according to states of the reference signals, applying the spread filter value to the gray data and generating final gray data, and displaying the final gray data on the PDP. The present invention reduces contour noise generated between moving pictures' adjacent grays.

17 Claims, 8 Drawing Sheets

FIG. 4a

10

| | | | | | | | |
|---|---|---|---|---|---|---|---|
| 0 | +1 | 0 | −1 | 0 | +1 | 0 | −1 |
| +1 | 0 | −1 | 0 | +1 | 0 | −1 | 0 |
| 0 | −1 | 0 | +1 | 0 | −1 | 0 | +1 |
| −1 | 0 | +1 | 0 | −1 | 0 | +1 | 0 |

FIG.4b

20

| | | | | | | | |
|---|---|---|---|---|---|---|---|
| 0 | −1 | 0 | +1 | 0 | −1 | 0 | +1 |
| −1 | 0 | +1 | 0 | −1 | 0 | +1 | 0 |
| 0 | +1 | 0 | −1 | 0 | +1 | 0 | −1 |
| +1 | 0 | −1 | 0 | +1 | 0 | −1 | 0 |

Fig. 9
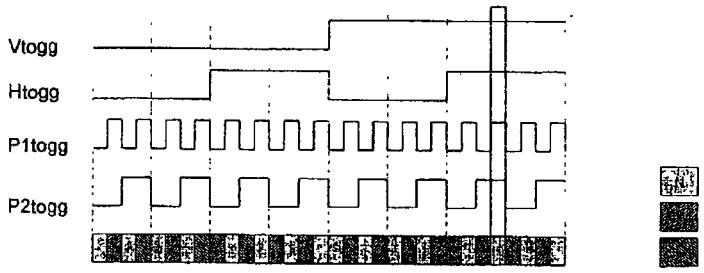
Fig. 10
STATE<=V_TOGG & H_TOGG & P1_TOGG & P2_TOGG
| State : Output | State : Output |
|---|---|
| 0000 : N | 1000 : N |
| 0001 : N | 1001 : N |
| 0010 : N+1 | 1010 : N-1 |
| 0011 : N-1 | 1011 : N+1 |
| 0100 : N+1 | 1100 : N-1 |
| 0101 : N-1 | 1101 : N+1 |
| 0110 : N | 1110 : N |
| 0111 : N | 1111 : N |
Fig. 11
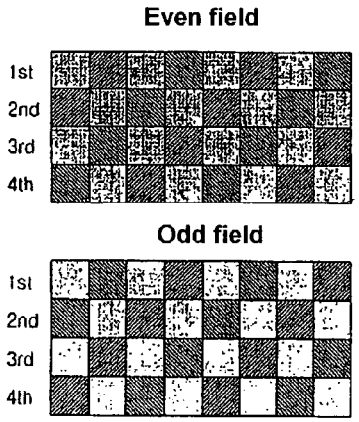

GRAY DISPLAY METHOD AND DEVICE FOR PLASMA DISPLAY PANEL

BACKGROUND OF THE INVENTION (a) Field of the Invention

The present invention relates to a plasma display panel (PDP). More specifically, the present invention relates to a method and device for displaying grays of a PDP that can reduce contour noise occurring when displaying moving pictures on the PDP.

(b) Description of the Related Art

A PDP arranges a plurality of discharge cells in a matrix format and emits light selectively using the discharge cells. Accordingly, the PDP is a display that restores input image data using electric signals.

In order to provide a fully functional color display PDP, the PDP is required to display different gray levels. A method of splitting a single field into a plurality of sub-fields and controlling the time division is used to implement different gray levels.

FIG. 1 shows a gray display method used in a conventional AC surface discharge PDP. In the drawing, the horizontal axis represents time and the vertical axis indicates a number of horizontal scanning lines.

This 8-bit gray implementation method divides a single field into eight sub-fields, and each sub-field includes an addressing period and a discharge-sustain period. The addressing period forms a wall charge on a selected cell of the PDP using a selective discharge by a write pulse, and writes relevent information. The discharge-sustain period represents a light-emitting period that actually displays images on the actual screen through discharging by continuous discharge-sustain pulses.

The discharge-sustain period has a light-emitting period ratio of 1:2:4:8:16:32:64:128. The different gray level on the PDP is implemented by accumulating in the human eyes for a period of time the lights irradiated by the selectively flickering sub-fields and have persons perceive the gray levels of average luminance For example, so as to implement the gray of level 3, when a sub-field having a period of 1T and a sub-field having a period of 2T are flickered, and a summation of the flickering period becomes 3T, human eyes perceive the gray of level 3 displayed with the disposed beams during the period of 3T. Similarly, when the gray of level 127, sequentially flickering the sub-fields respectively having the periods of 1T, 2T, 4T, 8T, 16T, 32T and 64T can achieve the luminance of level 127 according to the beams volume exposed during the total period of 127T. Thus, eight sub-fields can display all 256 grays ($2^8$=256).

The above-described PDP gray driving method works great for still images. When a viewer's viewpoint moves, however, the viewer see a distorted image displayed on the PDP. This is calles as contour noise, Contour noise depends on a product of light-emitting time of a pixel and a moving speed of a point and time asynchronism of the light-emitting. As a result, it distorts the gray levels or colors.

In particular, when the gray levels 127 and 128 are adjacent to each other, beams are emitted during the period of 1T, 2T, 4T, 8T, 16T, 32T, and 64T, which are provided on a first portion of a single field with respect to time so as to display the gray level 127. Then, beams are emitted during the period of 128T provided on a second portion of the single field. Accordingly, these two cases have a big difference of light-emitting time locations in the single field, generating a very high contour noise.

FIG. 2 shows a screen on which a contour noise is generated on a conventional AC-type surface discharge PDP.

As shown, the gray level of the left four columns of pixels is 127, and the gray level of the right four columns of the pixels is 128. When the pattern moves in the left direction by one pixel pitch for each field, a bright dispersion is formed on a boundary line A where the pixels of gray level 127 and the pixels of gray level 128 meet.

Conventional methods for reducing the contour noise are disclosed in the Japanese laid-open patents Nos. 1999-327491 and 1999-73157. In the first Japanese laid-open patent No. 1999-327491, each field is divided into light-emitting periods and pulse blanking periods with respect to time, and each light-emitting period is divided into a plurality of sub-fields with respect to time. In the pulse blanking period, neither a scanning electrode pulse nor a sustain electrode pulse is supplied, and scanning electrode and sustain electrode voltages are sustained at a predetermined level. Also, in the Japanese laid-open patent No. 1999-73157, the PDP includes a plurality of row electrodes corresponding to display lines and arranged in the horizontal direction, and a plurality of column electrodes arranged in the direction vertical to the row electrodes and forms cells where each row electrode and column electrode crosses. The display period is divided into a plurality of division periods, and a plurality of light-emitting modes. Each of the light-emitting modes has an order of a light-emitting period corresponding to the division period. Such light-emitting modes are alternately performed for each discharge cell or a block of discharge cells where a plurality of adjacent discharge cells form couples.

However, since the above-described conventional methods cannot sufficiently reduce the contour noise displayed longitudinally on the screen, viewers can recognize it.

SUMMARY OF THE INVENTION

It is an object of the present invention to provide a PDP gray display method and device for effectively reducing the moving contour noise generated between adjacent grays.

The present invention uses a spread filter for visually dispersing generation of contour noise when gray data corresponding to externally input image signals are generated.

In one aspect of the present invention, a gray-displaying method of a plasma display panel (PDP) for generating gray data corresponding to externally input image signals and displaying the gray data on the PDP comprise generating reference signals based on the image signals, determining a spread filter value according to states of the reference signals, applying the spread filter value to the gray data and generating final gray data, and displaying the final gray data on the PDP.

The spread filter value is differently established according to an even field and an odd field.

The spread filter value of the even field and the spread filter value of the odd field are configured to compensate for each other for a random pixel.

In another aspect of the present invention, a PDP gray display comprises: an image signal processor for receiving external image signals, digitizing them, and generating digital image data; a first reference signal generator for generating first reference signals for processing image signals on the basis of the external image signals; and a sub-field coder for applying spread filter values determined by the first reference signals corresponding to the digital image data generated by the image signal processor, generating final gray data, and outputting them to the PDP.

BRIEF DESCRIPTION OF THE DRAWINGS

The accompanying drawings, which are incorporated in and constitute a part of the specification, illustrate an embodiment of the invention, and, together with the description, serve to explain the principles of the invention.

FIGS. 4(*a*) and 4(*b*) show exemplified spread filters of FIG. 3. FIG. 4(*a*) shows an even field spread filter and FIG. 4(*b*) shows an odd field spread filter.

FIG. 5(*a*) shows an even field screen to which an even field spread filter is applied, and FIG. 5(*b*) shows an odd field screen to which an odd field spread filter is applied.

FIG. 9 shows spread filter values that a spread filter applier in the sub-field coder of FIG. 7 applies according to states of the reference signals.

FIG. 10 shows a logical operation of the spread filter applier in the sub-field coder of FIG. 7.

FIG. 11 shows a screen to which spread filter values are applied according to the PDP gray display of FIG. 6 and final gray data are separated.

DETAILED DESCRIPTION OF THE PREFERRED EMBODIMENTS

In the following detailed description, only the preferred embodiment of the present invention has been shown and described, simply by illustrating the best mode contemplated by the inventor(s) of carrying out the invention. As will be realized, the invention can be modified in various obvious respects, all without departing from the invention. Accordingly, the drawings and description are to be regarded as illustrative in nature, and not restrictive.

Figure 3:
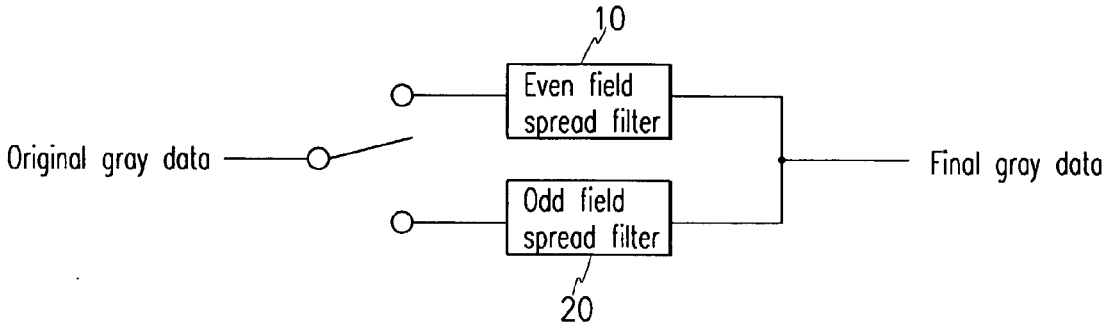
FIG. 3 shows a PDP gray display method according to a preferred embodiment of the present invention.

FIG. 3 shows a PDP gray display method according to a preferred embodiment of the present invention.

As shown, the PDP gray display method visually spreads the scattered grays, and applies a spread filter to original gray data determined by external image signals so as to generate final gray data.

Here, when applying the spread filter to the original gray data, an even field spread filter 10 is applied to the even field gray data, and an odd field spread filter 20 is applied to the odd field gray data.

In this instance, it is desirable that the gray data conversion by the even field spread filter 10 and the odd field spread filter 20 is performed so that signals may be processed in the opposite direction of random pixels.

For example, regarding a random pixel, when the even field spread filter 10 adds a random filter value n to the gray data of an even field, and converts the gray data, the odd field spread filter 20 subtracts the random filter value n from the gray data of an odd field of the random pixel and converts the gray data so as to amend the signal processing of the even field spread filter 10.

FIGS. 4(*a*) and 4(*b*) show exemplified spread filters of FIG. 3. FIG. 4(*a*) shows an even field spread filter 10 and FIG. 4(*b*) shows an odd field spread filter 20.

As shown, the even field spread filter 10 and the odd field spread filter 20 add a value 0, 1, or −1 to the original gray data to convert the original gray data.

Also, the addition of a value of the even field spread filter 10 and a value of the odd field spread filter 20 is configured to be zero so that the gray data converted by the even field spread filter 10 and the odd field spread filter 20 compensate for each other.

In the preferred embodiment, the values of the spread filters 10 and 20 are one of 0, 1, or −1, and without being restricted to these values, the preferred embodiment may have other values.

Further, the pixels to which the spread filters 10 and 20 are applied are in 4 rows and 8 columns in the preferred embodiment, but there can be a greater number, such as 640 columns and 480 rows.

Figure 1:
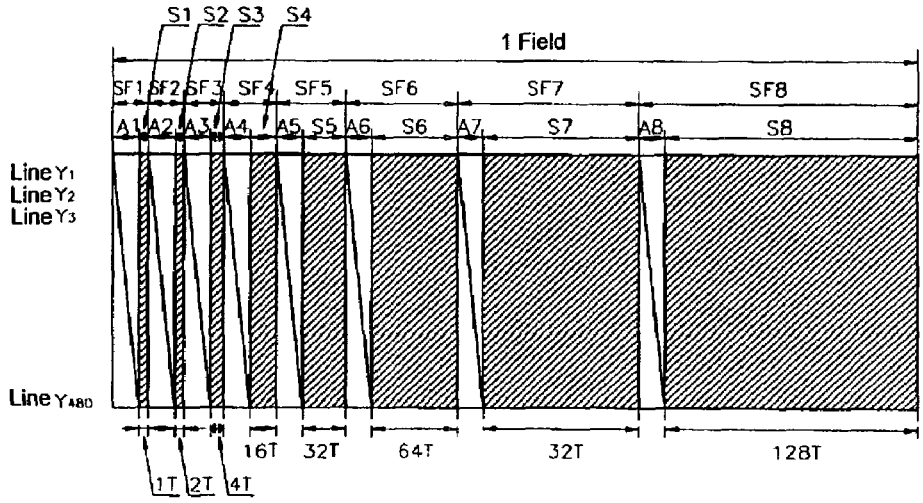
FIG. 1 shows a conventional gray display method of an AC surface discharge PDP.
Figure 2:
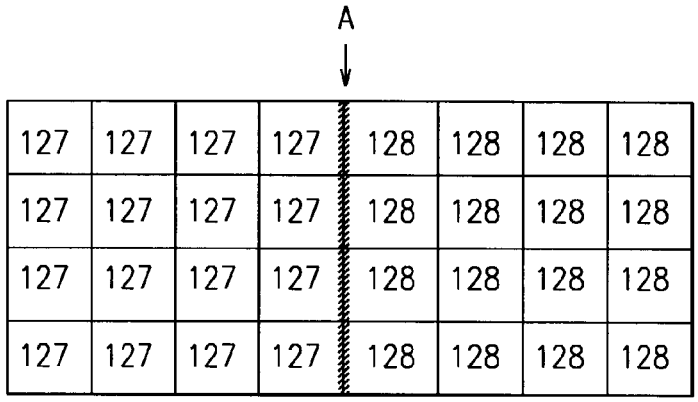
FIG. 2 shows a screen that shows contour noise on the conventional AC surface discharge PDP.
Figure 5A:
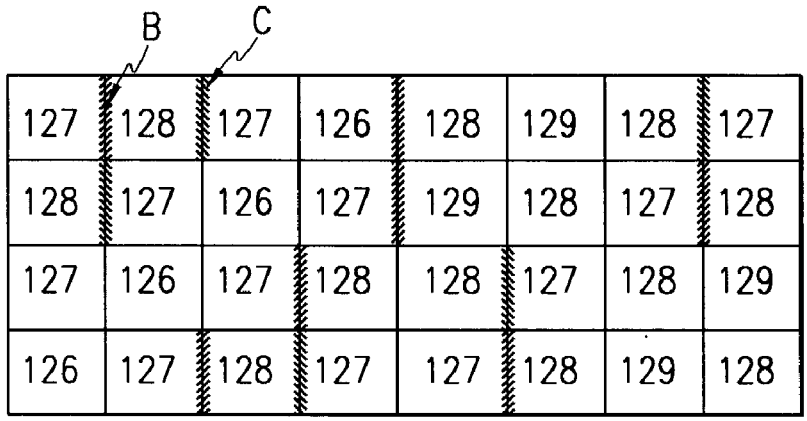
FIGS. 5(*a*) and 5(*b*) show a result screen of applying the spread filters of FIGS. 4(*a*) and 4(*b*) to the gray data of a screen generating a contour noise shown in FIG. 2.
Figure 5B:
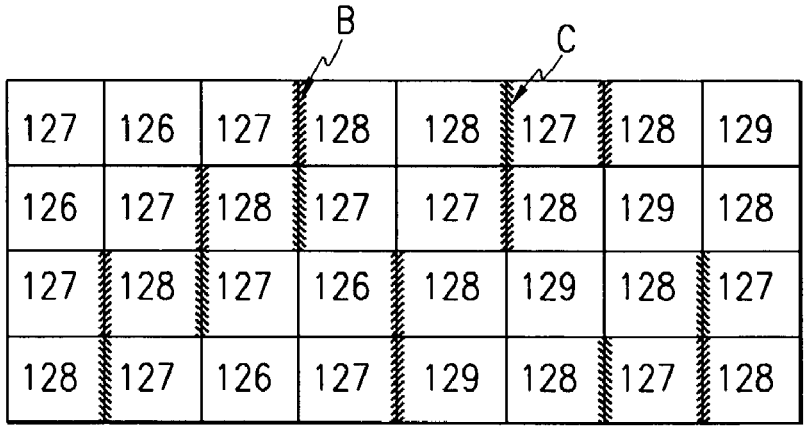

FIGS. 5(*a*) and 5(*b*) show a resulting screen after applying the spread filters of FIGS. 4(*a*) and 4(*b*) to the gray data of a screen generating a contour noise shown in FIG. 2. FIG. 5(*a*) shows an even field screen to which an even field spread filter 10 is applied, and FIG. 5(*b*) shows an odd field screen to which an odd field spread filter 20 is applied.

As shown, when the even field and odd field spread filters 10 and 20 are used to convert the original gray data, a bright dispersion (or a bright line) is generated on the pixel boundary portion B between the 127 gray level and the 128 gray level, and a dark dispersion (or a dark line) is generated on the pixel boundary portion C between the 128 gray level and the 127 gray level.

In this instance, the above-noted bright line or dark line can be generated on the pixel boundary portion between the 126 gray level pixel and the 128 gray level pixel or between the 127 gray level pixel and the 129 gray level pixel.

Here, the points where the bright lines and the dark lines are continuously generated compensate for each other since the pixel sizes are small. Accordingly, a person cannot recognize the no contour noise.

The occurrence of the bright lines shown in FIGS. 5(*a*) and 5(*b*) is almost identical to those shown in FIG. 2. In FIG. 2, the bright lines are continuously provided in the screen's vertical direction, rendering that any user can recognize the contour noise. In FIGS. 5(*a*) and 5(*b*), however, the bright lines are compensated for by some dark lines and are widely spread on the whole screen. Accordingly, it is not easy for the user to catch the contour noise. Thus, the overall display quality is improved.

Figure 6:
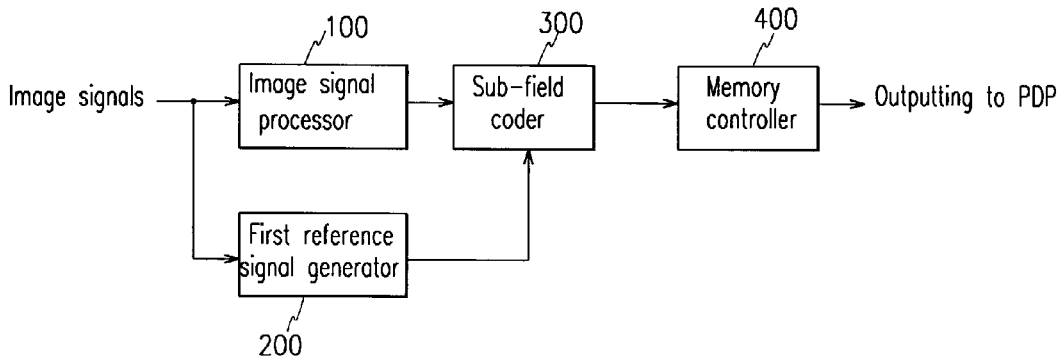
FIG. 6 shows a block diagram of a PDP gray display according to a preferred embodiment of the present invention.

FIG. 6 shows a block diagram of a PDP gray display according to a preferred embodiment of the present invention.

As shown, the PDP gray display comprises an image signal processor 100, a first reference signal generator 200, a sub-field coder 300, and a memory controller 400.

The image signal processor 100 converts the externally input image signals and generates RGB data in digital formats.

The first reference signal generator 200 generates reference signals for processing the image signals that include vertical synchronization signals Vsync for the reference to field signals, horizontal synchronization signals Hsync for the reference to lines and clock signals CLK for the reference to processing the whole signals.

The sub-field coder 300 receives the RGB data from the image signal processor 100 and the reference signals from the first reference signal generator 200, and generates gray data corresponding to the respective RGB pixel values. In this instance, the gray data corresponding to the RGB pixel values are referred to by a lookup table 320 in the sub-field coder 300. The referenced gray data are converted by the even field and odd field spread filters in the sub-field coder 300 so as to determine final gray data, and the final gray data are controlled by the memory controller 400 and then supplied to an address driver of a PDP (not illustrated).

Figure 7:
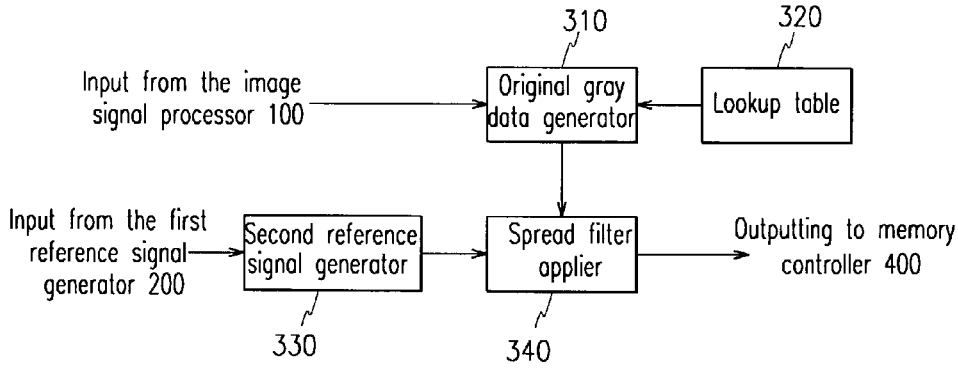
FIG. 7 shows a detailed block diagram of a sub-field coder of the PDP gray display of FIG. 6.

FIG. 7 shows a detailed block diagram of a sub-field coder 300 of the PDP gray display of FIG. 6.

As shown, the sub-field coder 300 comprises an original gray data generator 310, a lookup table 320, a second reference signal generator 330, and a spread filter applier 340.

The original gray data generator 310 receives the RGB pixel values from the image signal processor 100, and refers to the lookup table 320 to generate corresponding original gray data.

Figure 8:
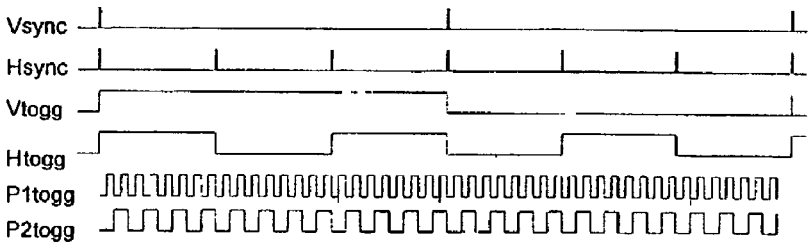
FIG. 8 shows a timing diagram of reference signals generated by a reference signal generator in the sub-field coder of FIG. 7.

The second reference signal generator 330 receives the reference signals Vsync, Hsync, and CLK from the first reference signal generator 200, and generates reference signals Vtogg, Htogg, P1togg, and P2togg to be applied to the spread filters. These reference signals are illustrated in FIG. 8.

As shown, the Vtogg signal inverts or toggles its signal level each time a Vsync signal is generated, the Htogg signal inverts its signal level each time a Hsync signal is generated, the P1togg signal inverts its signal level each time a clock signal is generated, and the P2togg signal inverts its signal level each time a P1togg signal is generated.

The spread filter applier 340 applies the spread filter values determined by the reference signals Vtogg, Htogg, P1togg, and P2togg, The second reference signal generator 330 generates such reference signals and provides them to the spread filter applier. The spread filter applier 340 applies the reference signals to the original gray data generated by the original gray data generator 310 to generate final gray data, and outputs them to an address driver of the PDP.

FIG. 9 shows spread filter values that a spread filter applier 340 of FIG. 7 applies according to states of the reference signals. FIG. 10 shows a logical operation of the spread filter applier 340 in the sub-field coder.

As shown in FIGS. 9 and 10, the spread filter applier 340 in the sub-field coder 300 combines the reference signals Vtogg, Htogg, P1togg, and P2togg input by the second reference signal generator 330 to generate a state signal STATE as follows:

STATE=Vtogg & Htogg & P1togg & P2togg, where the mark '&' represents to determine states using four reference signal values and not to perform logical product operation on the respective signals.

By adding the spread filter values (0, +1, −1) determined according to the states of the state signals STATE to the original gray data N input by the original gray data generator 310, the final gray data are generated.

FIG. 11 shows a screen after applying spread filter values according to the states of the reference signals. In this instance, the even field and the odd field are differently applied according to the Vtogg signal corresponding to the most significant bit (MSB) in the state signals STATE, and as shown in FIG. 10, the summation of the spread filter values applied by the even and odd fields with respect to identical pixels is configured to be zero.

Logic for applying the spread filter values to the original gray data N according to the states of the reference signals in the spread filter applier 340 can be implemented as follows by Very High speed integrated circuit hardware Description Language (VHDL) coding.

```
CASE STATE IS
WHEN (0010 OR 0100 OR 1011 OR 1101)=>N<=N+1;
WHEN (0011 OR 0101 OR 1010 OR 1100)=>N<=N−1;
WHEN OTHERS N<=N;
END CASE
```

By applying the above-implemented logic to the original gray data N according to the states of the state signals by the spread filter applier 340, the final gray data to which the spread filter is applied are generated, and the generated final gray data are controlled by the memory controller 400 to be output to the address driver. Accordingly, the screen of less contour noise as shown in FIGS. 5(*a*) and 5(*b*) is displayed by the PDP.

Figure 12:
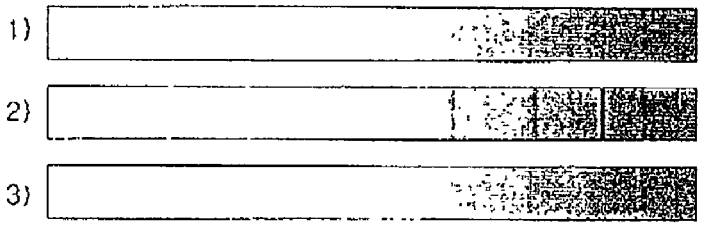
FIG. 12 shows an actual ramp waveform, a ramp waveform that generates contour noise, and a ramp waveform to which a spread filter is applied by the PDP gray display of FIG. 6.

FIG. 12 shows actual images, images on which contour noise is displayed, and images to which a spread filter is applied by the PDP gray display of FIG. 6.

The images of FIG. 12 (1) are actual images, and when these images are moved in the left direction, a black band as shown in (2) is generated because of the contour noise generated by the PDP. When the images are moved in the right direction, a white band is generated. This contour noise distorts the actual images, thereby degrading image qualities. Drawing (3) shows images to which a spread filter according to the preferred embodiment of the present invention is applied. As the band-type contour noise displayed in (2) becomes pale, the contour noise in the PDP is greatly reduced.

As described, in the preferred embodiment, the original gray data are converted by applying one of the spread filter values 0, 1, or −1 to the original gray data. However, only 1 and −1 can be used as the spread filter values without using 0.

Also, the orders of applying the spread filter values of 0, +1, and −1 can be different.

Further, in the above, the spread filters are applied to all PDP pixels. Depending on the application, the spread filters can be only applied to the pixels where the contour noise is detected on the PDP, which will be easily understood by a skilled person.

According to the present invention, the spread filter values are determined by the states of the reference signals that is generated by the external image signals. The contour noise generated between the moving pictures' adjacent gray levels can be reducedby applying the spread filter values.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for displaying a gray level in a plasma display panel (PDP) by generating gray data corresponding to externally input image signals and displaying the gray data on the PDP, comprising steps of:

generating reference signals using the image signals;

determining a spread filter value according to states of the reference signals;

applying the spread filter value to the gray data and generating final gray data; and displaying the final gray data on the PDP.

2. The method of claim 1, wherein the spread filter value of an even field is different from the spread filter value of an odd field.

3. The method of claim 2, wherein the spread filter value of the even field and the spread filter value of the odd field are configured to compensate for each other.

4. The method of claim 3, wherein the gray data are added to the spread filter value to generate final gray data.

5. The method of claim 4, wherein the spread filter value has one of the values 0, +1, and −1, and is determined according to the states of the reference signals.

6. A plasma display panel (PDP) gray display, comprising:

an image signal processor for receiving external image signals and converting the external image signals into digital image data;

a first reference signal generator for generating first reference signals for processing image signals on the basis of the external image signals; and a sub-field coder that applies spread filter values to gray data corresponding to the digital image data to generate final gray data.

7. The display of claim 6, wherein the sub-field coder comprises:

a lookup table for setting the gray data corresponding to the digital image data;

an original gray data generator for referring to the lookup table and determining the original gray data corresponding to the digital image data;

a second reference signal generator for generating second reference signals for determining the spread filter value on the basis of the first reference signals; and a spread filter applier for applying the spread filter value determined according to the states of the second reference signal to the original gray data to generate the final gray data, and outputting the final gray data to the PDP.

8. The display of claim 7, wherein the first reference signals comprise a vertical synchronization signal, a horizontal synchronization signal, and a system clock signal.

9. The display of claim 8, wherein the second reference signals comprise:

a first signal having signal levels inverted each time the vertical synchronization signal is generated;

a second signal having signal levels inverted each time the horizontal synchronization signal is generated;

a third signal having signal levels inverted each time the system clock signal is generated; and a fourth signal having signal levels inverted each time the third signal is generated, wherein the spread filter applier combines the states of the first signal, the second signal, the third signal, and the fourth signal to determine the spread filter value.

10. The display of claim 9, wherein the spread filter value of an even field is different from the spread filter value of an odd field.

11. The display of claim 10, wherein the spread filter values of the even field and the odd field are configured to compensate for each other.

12. The display of claim 11, wherein the spread filter applier adds the established spread filter value to the original gray data to generate final gray data.

13. The display of claim 12, wherein the spread filter value has one of the values 0, +1, and −1.

14. A method for displaying a gray level in a plasma display panel (PDP) by generating gray data corresponding to externally input image signals, comprising steps of:

determining a spread filter value according to an even field and an odd field, wherein a spread filter value of the even field and a spread filter value of the odd field are different;

applying the respective spread filter values to the gray data and generating final gray data; and displaying the final gray data on the PDP.

15. The method of claim 14, wherein the spread filter value of the even field and the spread filter value of the odd field are configured to compensate for each other.

16. The method of claim 15, wherein the spread filter value is added to the gray data to generate the final gray data.

17. The method of claim 16, wherein the spread filter value has one of the values 0, +1, and −1, and is determined according to locations of the respective pixels of the even field and the odd field.

* * * * *